US011441281B2

(12) United States Patent
Fukano et al.

(10) Patent No.: US 11,441,281 B2
(45) Date of Patent: Sep. 13, 2022

(54) SNOW REMOVAL MACHINE

(71) Applicant: HONDA MOTOR CO., LTD., Tokyo (JP)

(72) Inventors: Jun Fukano, Wako (JP); Toshiaki Kawakami, Wako (JP); Tsutomu Mizoroke, Wako (JP); Atsushi Moroi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 299 days.

(21) Appl. No.: 16/765,494

(22) PCT Filed: Nov. 22, 2017

(86) PCT No.: PCT/JP2017/041926

§ 371 (c)(1),
(2) Date: May 20, 2020

(87) PCT Pub. No.: WO2019/102534

PCT Pub. Date: May 31, 2019

(65) Prior Publication Data

US 2020/0291590 A1 Sep. 17, 2020

(51) Int. Cl.
*E01H 5/08* (2006.01)
*E01H 5/09* (2006.01)

(52) U.S. Cl.
CPC ..... *E01H 5/08* (2013.01); *E01H 5/098* (2013.01)

(58) Field of Classification Search
CPC ..... E01H 5/08; E01H 5/098
See application file for complete search history.

(56) References Cited

U.S. PATENT DOCUMENTS

2014/0202047 A1* 7/2014 Kawakami ..... E01H 5/098 37/257
2015/0107134 A1* 4/2015 Fukano ..... E01H 5/098 37/234

(Continued)

FOREIGN PATENT DOCUMENTS

CA 2838898 A1 * 7/2014 ..... E01H 5/04
JP 2007-092324 4/2007

OTHER PUBLICATIONS

International Search Report and Written Opinion for International Application No. PCT/JP2017/041926 dated Feb. 13, 2018, 6 pages.

*Primary Examiner* — Jamie L McGowan
(74) *Attorney, Agent, or Firm* — Amin, Turocy & Watson, LLP

(57) ABSTRACT

A snow removal machine has: a storage unit that stores a vehicle speed coefficient map indicating the relationship between an incline angle and a vehicle speed coefficient for decreasing an instructed vehicle speed; a vehicle speed coefficient setting unit that sets the vehicle speed coefficient on the basis of a detected incline angle and the vehicle speed coefficient map; and a vehicle speed setting unit that sets the vehicle speed of a traveling unit by way of multiplying the instructed vehicle speed by the set vehicle speed coefficient. The vehicle speed coefficient map sets the vehicle speed coefficient so same is smaller for larger incline angles when at least the traveling unit is going forward on an upslope. A travel control unit controls a drive source so that the traveling unit travels at the set vehicle speed set by the vehicle speed setting unit.

8 Claims, 6 Drawing Sheets

(56) References Cited

U.S. PATENT DOCUMENTS

2015/0107135 A1* 4/2015 Fukano ..... E01H 5/04
37/234
2015/0107136 A1* 4/2015 Fukano ..... E01H 5/04
37/235

* cited by examiner

SNOW REMOVAL MACHINE

TECHNICAL FIELD

The present invention relates to a snow removal machine that includes a traveling section provided with a snow removal section for performing snow removal work and configured to travel under action of a drive source.

BACKGROUND ART

Japanese Laid-Open Patent Publication No. 2007-092324 discloses a snow removal machine that causes a traveling section to travel under action of an electric motor. In this snow removal machine, when the traveling section moves forward along an upslope, deceleration is achieved by outputting to the electric motor a reverse phase rotation control signal commensurate with a rotation speed of the electric motor.

SUMMARY OF INVENTION

Incidentally, in the snow removal machine, sometimes, when a snowfall amount is large, snow is removed in stages while traveling along a slope surface, that is, an oblique stepped clearing operation is performed. In such a case, a large load acts on a rear end portion of the traveling section, and hence the traveling section sometimes gets stuck in the snow. At this time, if a travel vehicle speed is comparatively large, it is easy for the traveling section to get stuck in the snow. Such a state of the traveling section getting stuck in the snow may occur when the traveling section travels along the slope not just in the case where the oblique stepped clearing operation is performed.

In the above-mentioned Japanese Laid-Open Patent Publication No. 2007-092324, the traveling section decelerates when moving forward along the upslope, and it is therefore possible to reduce the traveling section getting stuck in the snow. However, since the reverse phase rotation control signal commensurate with the rotation speed of the electric motor is outputted to the electric motor, there is a risk of control becoming complicated.

The present invention has been made in view of such problems, and has an object of providing a snow removal machine that can prevent the traveling section from getting stuck in the snow, by simple control.

In order to achieve the above-described object, according to the present invention, there is provided a snow removal machine including: a traveling section which is provided with a snow removal section configured to perform snow removal work, the traveling section being configured to travel under action of a drive source; and a travel control section configured to control the drive source, the snow removal machine including: an inclination angle detecting section configured to detect an inclination angle with respect to a horizontal plane in a front-rear direction of the traveling section; a storage section that has stored therein a vehicle speed coefficient map indicating a relationship between a vehicle speed coefficient for decreasing an instructed vehicle speed and the inclination angle; a vehicle speed coefficient setting section configured to set the vehicle speed coefficient based on the inclination angle detected by the inclination angle detecting section, and the vehicle speed coefficient map; and a vehicle speed setting section configured to set the vehicle speed of the traveling section by multiplying the instructed vehicle speed by the vehicle speed coefficient set by the vehicle speed coefficient setting section, wherein the vehicle speed coefficient map is set so that, at least in the case of the traveling section moving forward along an upslope, as the inclination angle becomes larger, the vehicle speed coefficient becomes smaller, and the travel control section controls the drive source so that the traveling section travels at a set vehicle speed set by the vehicle speed setting section.

With such a configuration, the vehicle speed of the traveling section can be set by multiplying the instructed vehicle speed by the vehicle speed coefficient set based on the inclination angle and the vehicle speed coefficient map, and thus the traveling section can be decelerated at least when the traveling section moves forward along an upslope, by simple control. As a result, it is possible to suppress such a situation that the traveling section gets stuck in the snow.

In the above-described snow removal machine, the vehicle speed coefficient map may be set so that, in the case of the traveling section moving forward along an upslope, in a case of the traveling section moving forward along a downslope, in a case of the traveling section moving backward along an upslope, and in a case of the traveling section moving backward along a downslope, as the inclination angle becomes larger, the vehicle speed coefficient becomes smaller.

With such a configuration, the traveling section can be effectively prevented from getting stuck in the snow.

In the above-described snow removal machine, the vehicle speed coefficient map may be set so that, between the cases of the traveling section moving forward and moving backward along a slope, the vehicle speed coefficients with respect to the same inclination angle differ from each other.

With such a configuration, the vehicle speed of the traveling section can be changed between the cases of the traveling section moving forward and moving backward, even if the instructed vehicle speeds are the same.

In the above-described snow removal machine, the vehicle speed coefficient map may be set so that, between the cases of the traveling section ascending and descending a slope, the vehicle speed coefficients with respect to the same inclination angle differ from each other.

With such a configuration, the vehicle speed of the traveling section can be changed between the cases of the traveling section ascending and descending a slope, even if the instructed vehicle speeds are the same.

In the above-described snow removal machine, the vehicle speed coefficient map may be set so that, on upslopes of the same inclination angle, the vehicle speed coefficient in the case of the traveling section moving backward is larger than the vehicle speed coefficient in the case of the traveling section moving forward.

With such a configuration, it is possible to suppress such a situation that it is slow in movement in the case of moving backward along an upslope.

In the above-described snow removal machine, the vehicle speed coefficient map may be set so that a lower limit of the vehicle speed coefficient is 0.25.

With such a configuration, it is possible to suppress such a situation that the vehicle speed of the traveling section becomes excessively slow.

In the above-described snow removal machine, the vehicle speed coefficient map may be set so that in a case of the inclination angle being 10° or less, the vehicle speed coefficient is 1.

With such a configuration, the traveling section can be caused to travel smoothly in the case of there being a gentle inclination angle at which it is comparatively difficult for getting-stuck to occur.

In the above-described snow removal machine, the travel control section may control the drive source so that the traveling section gradually accelerates or decelerates to the set vehicle speed.

With such a configuration, a sudden change in vehicle speed of the traveling section can be suppressed.

DESCRIPTION OF EMBODIMENTS

A preferred embodiment of a snow removal machine according to the present invention will be presented and described below with reference to the accompanying drawings.

Figure 1:
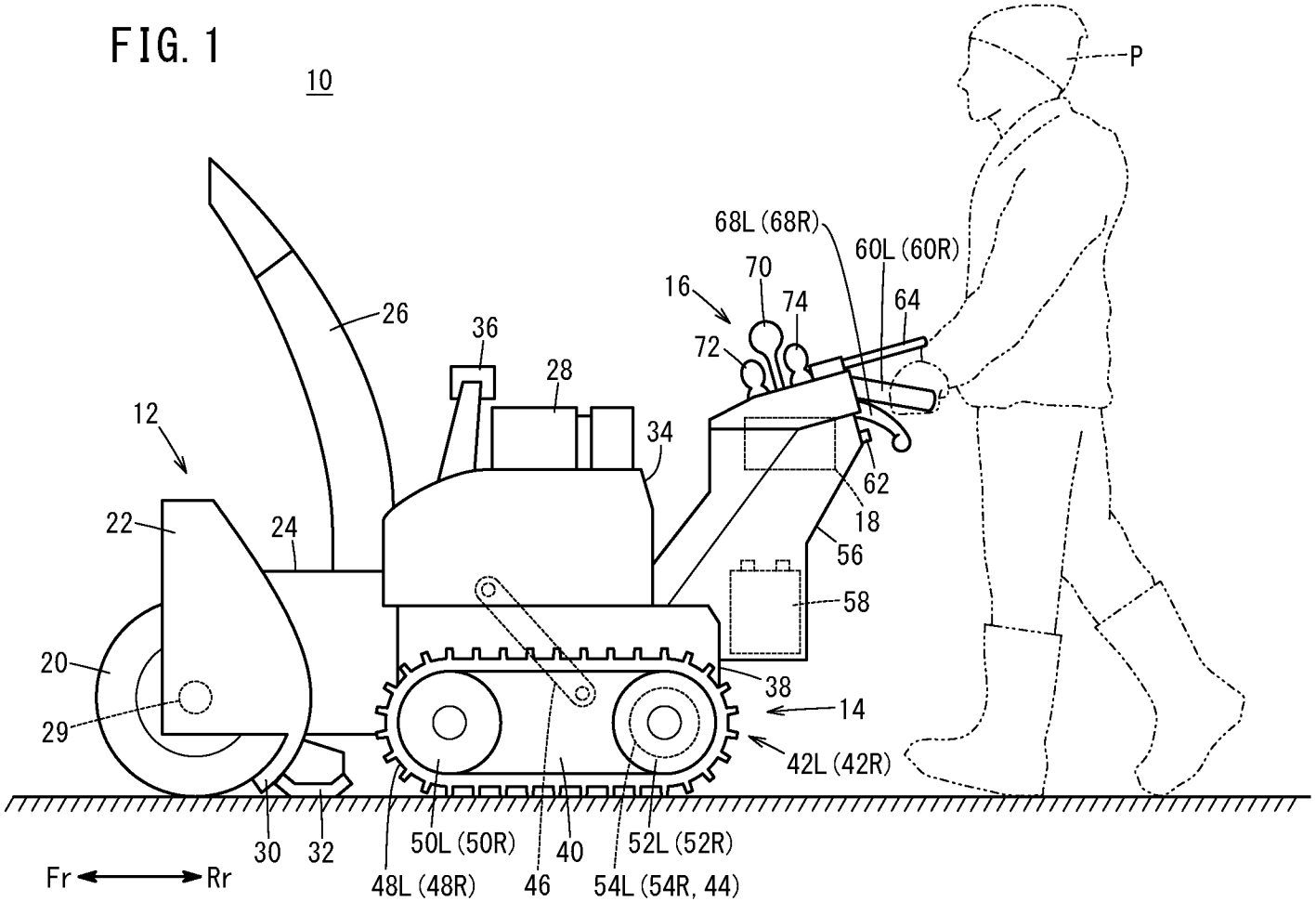
FIG. 1 is a side view of a snow removal machine according to an embodiment of the present invention.

As shown in FIG. 1, a snow removal machine 10 is a walking type snow removal machine that performs snow removal work while traveling under action of a drive source 44. In FIG. 1, the arrow Fr indicates frontward of the snow removal machine 10 (the same as frontward as observed by an operator P), and the arrow Rr indicates rearward of the snow removal machine 10 (the same as rearward as observed by the operator P).

As shown in FIG. 1, the snow removal machine 10 includes a snow removal section 12, a traveling section 14, an operation section 16, and a control section 18. The snow removal section 12, which is for performing snow removal work, includes an auger 20, an auger housing 22, a blower case 24, a shooter 26, and an engine 28.

The auger 20, which is for gathering up snow, is provided in a front end portion of the snow removal machine 10. The auger 20 is provided on a rotating shaft 29 that extends in a left-right direction. The rotating shaft 29 is supported rotatably by the auger housing 22.

The auger housing 22 is a protective cover that covers the auger 20 from above, from the sides, and from behind. The auger housing 22 guides into the blower case 24 the snow that has been gathered up by the auger 20. A rear end lower portion of the auger housing 22 is provided with a scraper 30 and a sled 32.

The blower case 24, which houses an unillustrated blower for discharging (throwing) the snow that has been led from the auger housing 22, is coupled to a rear portion of the auger housing 22. The shooter 26 extends out upwardly from an upper portion of the blower case 24. The shooter 26 is configured to enable a snow-throwing direction and a snow-throwing distance to be changed.

The engine 28 rotates the auger 20 via an unillustrated power transmission mechanism. The engine 28 includes an engine cover 34 that covers an unillustrated engine main body. The engine cover 34 is coupled to a rear portion of the blower case 24. An upper portion of the engine cover 34 is provided with a working light 36.

The traveling section 14 includes a vehicle body frame 38, a traveling frame 40, left and right crawler sections 42L, 42R, and the drive source 44. The vehicle body frame 38 supports the snow removal section 12. The vehicle body frame 38 is provided with an elevating mechanism 46 for adjusting a height position of the auger housing 22. The traveling frame 40 supports the vehicle body frame 38.

The crawler section 42L includes: a looped crawler belt 48L; and a rolling wheel 50L and driving wheel 52L provided within the crawler belt 48L. The rolling wheel 50L supports a front portion of the crawler belt 48L. The driving wheel 52L supports a rear portion of the crawler belt 48L, and rotates the crawler belt 48L. However, positions of the rolling wheel 50L and the driving wheel 52L may be mutually reversed. The crawler section 42R is configured similarly to the crawler section 42L, and includes a crawler belt 48R, a rolling wheel 50R, and a driving wheel 52R.

The drive source 44 includes left and right electric motors 54L, 54R provided in the traveling frame 40. The electric motor 54L rotates the left driving wheel 52L. The electric motor 54R rotates the right driving wheel 52R.

The operation section 16 includes an operation box 56 that extends out obliquely upwardly rearwards from a rear end portion of the vehicle body frame 38. A battery 58 for supplying electric power to the electric motors 54L, 54R, the control section 18, and so on, is disposed in the operation box 56.

Figure 2:
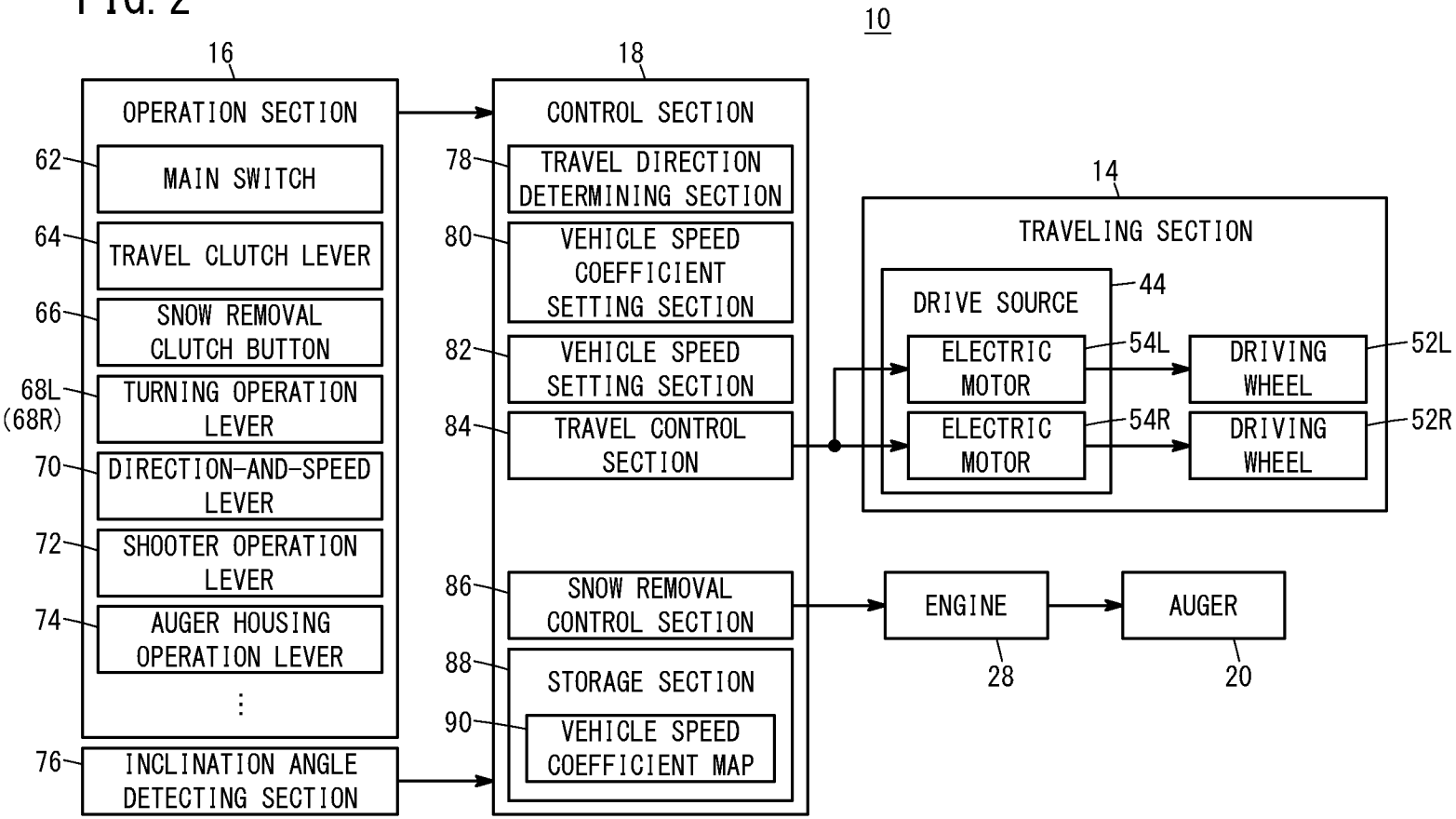
FIG. 2 is a control block diagram of the snow removal machine of FIG. 1.

As shown in FIGS. 1 and 2, an upper end portion of the operation box 56 is provided with handle grips 60L, 60R (refer to FIG. 1), a main switch 62, a travel clutch lever 64, a snow removal clutch button 66 (refer to FIG. 2), left and right turning operation levers 68L, 68R, a direction-and-speed lever 70, a shooter operation lever 72, an auger housing operation lever 74, and so on.

The handle grips 60L, 60R are gripped and operated by the operator P. The main switch 62 is configured to be switchable between ON starting the engine 28 and OFF stopping the engine 28. The travel clutch lever 64 is positioned in a vicinity of (above) the handle grips 60L, 60R so as to be easily gripped by the operator P. The snow removal machine 10 starts traveling by the operator P gripping the travel clutch lever 64.

The turning operation levers 68L, 68R are positioned in a vicinity of (below) the handle grips 60L, 60R so as to be easily gripped by the operator P. The snow removal machine 10 turns to the left by the operator P gripping the turning operation lever 68L, and turns to the right by the operator P gripping the turning operation lever 68R.

The direction-and-speed lever 70 is configured to have its position switched between forward movement, neutral, and backward movement. The snow removal machine 10 moves forward in a state where the direction-and-speed lever 70 is positioned at forward movement, stops in a state where the direction-and-speed lever 70 is positioned at neutral, and moves backward in a state where the direction-and-speed lever 70 is positioned at backward movement.

The direction-and-speed lever 70 can have its position of forward movement changed stepwise or continuously. As a result, forward movement vehicle speed of the snow removal machine 10 can be adjusted. The direction-and-speed lever 70 can have its position of backward movement changed stepwise or continuously. As a result, backward movement vehicle speed of the snow removal machine 10 can be adjusted.

The shooter operation lever 72 is used for operating an orientation of the shooter 26. The auger housing operation lever 74 is used for operating a position of the auger housing 22.

The operation box 56 has arranged therein an inclination angle detecting section 76 (refer to FIG. 2) and the control section 18. The inclination angle detecting section 76 is a sensor that detects an inclination angle with respect to a horizontal plane in a front-rear direction of the traveling section 14. A G sensor, for example, is employed as the inclination angle detecting section 76. An output signal from the inclination angle detecting section 76 is inputted to the control section 18. In the description below, the inclination angle with respect to a horizontal plane in the front-rear direction of the traveling section 14 will simply be called an "inclination angle".

As shown in FIG. 2, the control section 18 is a calculator including a microcomputer, includes a CPU (Central Processing Unit), a ROM and RAM being memories, and so on, and by the CPU reading and executing a program stored in the ROM, functions as a various function realizing section (a function realizing means). Note that the various function realizing sections can also be configured by a function realizing apparatus as hardware.

Output signals are inputted to the control section 18 from the operation section 16 (the main switch 62, the travel clutch lever 64, the left and right turning operation levers 68L, 68R, the direction-and-speed lever 70, the shooter operation lever 72, the auger housing operation lever 74, and so on). The control section 18 includes the likes of a travel direction determining section 78, a vehicle speed coefficient setting section 80, a vehicle speed setting section 82, a travel control section 84, a snow removal control section 86, and a storage section 88 (a memory).

The travel direction determining section 78 determines a travel direction (forward movement or backward movement) of the traveling section 14, based on the output signal from the direction-and-speed lever 70. The vehicle speed coefficient setting section 80 sets a vehicle speed coefficient based on the inclination angle detected by the inclination angle detecting section 76, and a vehicle speed coefficient map 90.

The vehicle speed setting section 82 sets a vehicle speed of the traveling section 14 by multiplying an instructed vehicle speed by the vehicle speed coefficient set by the vehicle speed coefficient setting section 80. The instructed vehicle speed is acquired based on the output signal of the direction-and-speed lever 70. The travel control section 84 controls the drive source 44 (the electric motors 54L, 54R) so that the traveling section 14 travels at a set vehicle speed set by the vehicle speed setting section 82. The travel control section 84 controls the drive source 44 so that the traveling section 14 gradually accelerates or decelerates to the set vehicle speed set by the vehicle speed setting section 82. The snow removal control section 86 controls the engine 28 to rotate the auger 20. The storage section 88 has stored therein the vehicle speed coefficient map 90 indicating a relationship between the vehicle speed coefficient for decreasing the instructed vehicle speed and the inclination angle.

Figure 3:
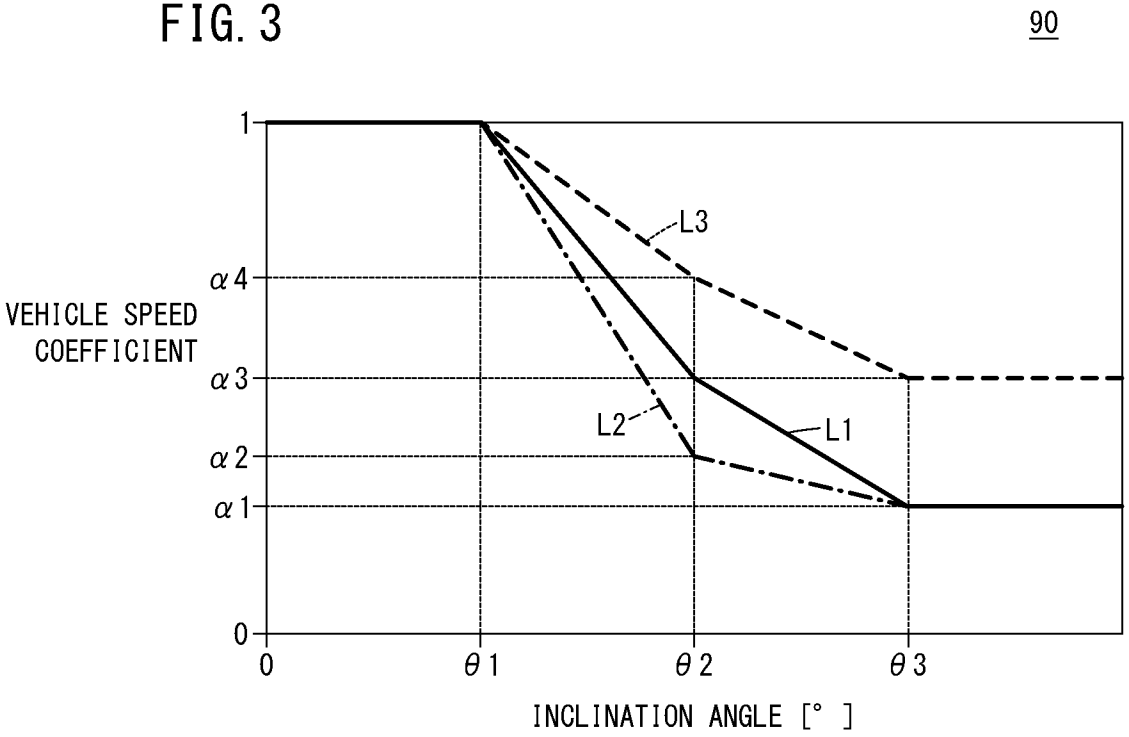
FIG. 3 is a graph showing a vehicle speed coefficient map.

As shown in FIG. 3, a graph whose horizontal axis is the inclination angle and whose vertical axis is the vehicle speed coefficient, for example, is employed as the vehicle speed coefficient map 90. The graph shows line segments L1-L3. Line segment L1 shows the relationship between the inclination angle and the vehicle speed coefficient in the case of moving forward along an upslope and a downslope. Line segment L2 shows the relationship between the inclination angle and the vehicle speed coefficient in the case of moving backward along a downslope. Line segment L3 shows the relationship between the inclination angle and the vehicle speed coefficient in the case of moving backward along an upslope.

In this vehicle speed coefficient map 90, setting is made so that in a range of the inclination angle being θ1 or less, the vehicle speed coefficient is 1, and so that the larger than θ1 the inclination angle becomes, the smaller the vehicle speed coefficient. The inclination angle θ1 is set to 10°, for example. However, the inclination angle θ1 can be arbitrarily set.

The vehicle speed coefficient map 90 is set so that, between the cases of the traveling section 14 moving forward and moving backward along a slope, the vehicle speed coefficients with respect to the same inclination angle differ from each other. Specifically, in the case of the inclination angle being θ2, a vehicle speed coefficient α3 of the line segment L1 in the case of the traveling section 14 moving forward along an upslope is smaller than a vehicle speed coefficient α4 of the line segment L3 in the case of the traveling section 14 moving backward along the upslope. In the case of the inclination angle being θ2, the vehicle speed coefficient α3 of the line segment L1 in the case of the traveling section 14 moving forward along a downslope is larger than a vehicle speed coefficient α2 of the line segment L2 in the case of the traveling section 14 moving backward along the downslope.

The vehicle speed coefficient map 90 is set so that, between the cases of the traveling section 14 ascending and descending a slope, the vehicle speed coefficients with respect to the same inclination angle differ from each other. Specifically, in the case of the inclination angle being θ2, the vehicle speed coefficient α4 of the line segment L3 in the case of the traveling section 14 moving backward along an upslope is larger than the vehicle speed coefficient α2 of the line segment L2 in the case of the traveling section 14 moving backward along a downslope.

The vehicle speed coefficient map 90 is set so that, on upslopes of the same inclination angle, the vehicle speed coefficient in the case of the traveling section 14 moving backward is larger than the vehicle speed coefficient in the case of the traveling section 14 moving forward. Specifically, in the case of the inclination angle being θ2, the vehicle speed coefficient α4 of the line segment L3 in the case of the traveling section 14 moving backward along the upslope is larger than the vehicle speed coefficient α3 of the line segment L1 in the case of the traveling section 14 moving forward along the upslope.

In the vehicle speed coefficient map 90, a lower limit of the vehicle speed coefficient (the vehicle speed coefficient α1 in the case of the inclination angle being θ3) for the line segment L1 and the line segment L2, is set to 0.25. A lower limit of the vehicle speed coefficient (the vehicle speed coefficient α3 in the case of the inclination angle being θ3) for the line segment L3 is larger than the vehicle speed coefficient α1.

Next, operation of the snow removal machine 10 configured as above, will be described.

When performing snow removal work, the operator P starts the engine 28 by setting the main switch 62 to ON, in a state of the direction-and-speed lever 70 being positioned at neutral. Then, the operator P grips the travel clutch lever 64 along with the handle grips 60L, 60R, and operates the snow removal clutch button 66. Upon that being done, the auger 20 rotates, and the unillustrated blower starts up. Subsequently, the direction-and-speed lever 70 is shifted to forward movement, whereby the snow removal machine 10 is moved forward. At this time, the operator P changes the position of the direction-and-speed lever 70 to adjust the vehicle speed, according to snow quality or amount of snow.

The auger 20 gathers up the snow in front of it into the auger housing 22. The snow that has been gathered in the auger housing 22 is guided into the blower case 24 and, due to action of the unillustrated blower, the snow is thrown far away via the shooter 26. In this way, the snow removal work is implemented.

Next, vehicle speed control of the snow removal machine 10 will be described.

Figure 4:
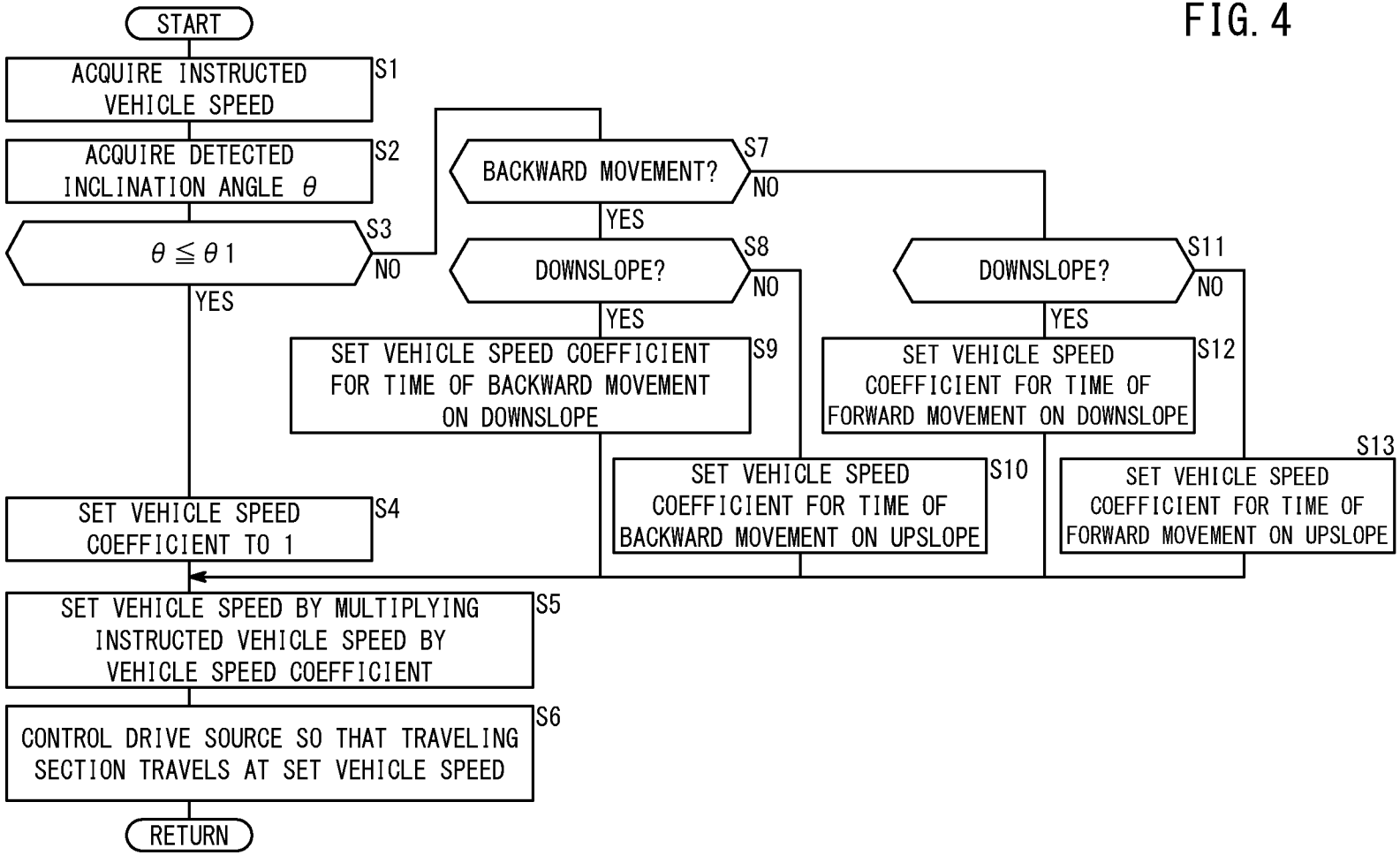
FIG. 4 is a flowchart for explaining vehicle speed control of the snow removal machine of FIG. 1.

In vehicle speed control of the snow removal machine 10, first, in step S1 of FIG. 4, the control section 18 acquires the instructed vehicle speed. The instructed vehicle speed is acquired based on the output signal from the direction-and-speed lever 70.

Subsequently, in step S2, the control section 18 acquires a detected inclination angle θ that has been detected by the inclination angle detecting section 76. Then, in step S3, the control section 18 determines whether or not the detected inclination angle θ is less than or equal to a certain inclination angle θ1 (θ≤θ1).

If, in step S3, it is determined by the control section 18 that the detected inclination angle θ is less than or equal to the inclination angle θ1, then in step S4, the vehicle speed coefficient setting section 80 refers to the vehicle speed coefficient map 90, and thereby sets the vehicle speed coefficient to 1.

Then, in step S5, the vehicle speed setting section 82 sets the vehicle speed by multiplying the instructed vehicle speed by the vehicle speed coefficient. If the detected inclination angle θ is less than or equal to the inclination angle θ1, then the instructed speed becomes the set speed without change. Then, in step S6, the travel control section 84 controls the drive source 44 (the electric motors 54L, 54R) so that the traveling section 14 travels at the set speed set by the vehicle speed setting section 82. Subsequently, processing of step S1 onwards is repeatedly performed.

If, in step S3, it is determined by the control section 18 that the detected inclination angle θ is greater than the certain inclination angle θ1, then in step S7, the travel direction determining section 78 determines whether the travel direction is backward movement, or not. At this time, the travel direction determining section 78 determines the traveling section 14 to be moving forward in the case of the direction-and-speed lever 70 being positioned at forward movement, and determines the traveling section 14 to be moving backward in the case of the direction-and-speed lever 70 being positioned at backward movement.

If, in step S7, it is determined by the travel direction determining section 78 that the traveling section 14 is moving backward, then in step S8, the control section 18 determines whether the slope is a downslope, or not. The control section 18 determines the slope to be an upslope in the case of the output signal from the inclination angle detecting section 76 being a positive value, and determines the slope to be a downslope in the case of the output signal from the inclination angle detecting section 76 being a negative value, for example. Note that in the vehicle speed coefficient setting section 80, an absolute value of the output signal from the inclination angle detecting section 76 is used.

If, in step S8, it is determined by the control section 18 that the slope is a downslope, then in step S9, the vehicle speed coefficient setting section 80 refers to the vehicle speed coefficient map 90 and then sets a vehicle speed coefficient for a time of backward movement on a downslope. Specifically, for example, in the case of the of the vehicle speed coefficient map 90 and then sets the vehicle speed coefficient to α2, and in the case of the inclination angle being θ3, it refers to the line segment L2 of the vehicle speed coefficient map 90 and then sets the vehicle speed coefficient to α1 (refer to FIG. 3).

Subsequently, in step S5, the vehicle speed setting section 82 sets the vehicle speed by multiplying the instructed vehicle speed by the vehicle speed coefficient. If the detected inclination angle θ is greater than the inclination angle θ1, then the vehicle speed coefficient is less than 1, hence the set vehicle speed becomes less than the instructed vehicle speed. Subsequently, the above-mentioned processing of step S6 is performed, and thereafter processing of step S1 onwards is repeatedly performed.

If, in step S8, it is determined by the control section 18 that the slope is not a downslope (the slope is an upslope), then in step S10, the vehicle speed coefficient setting section 80 refers to the vehicle speed coefficient map 90 and then sets a vehicle speed coefficient for a time of backward movement on an upslope. Specifically, for example, in the case of the inclination angle being θ2, it refers to the line segment L3 of the vehicle speed coefficient map 90 and then sets the vehicle speed coefficient to α4, and in the case of the inclination angle being θ3, it refers to the line segment L3 of the vehicle speed coefficient map 90 and then sets the vehicle speed coefficient to α3 (refer to FIG. 3). Subsequently, the above-mentioned processing of step S5 and processing of step S6 are performed, and thereafter processing of step S1 onwards is repeatedly performed.

If, in step S7, it is determined by the travel direction determining section 78 that the traveling section 14 is moving forward, then in step S11, the control section 18 determines whether the slope is a downslope, or not. Processing of this step S11 is similar to the above-mentioned processing of step S8, hence a detailed description thereof will be omitted.

If, in step S11, it is determined by the control section 18 that the slope is a downslope, then in step S12, the vehicle speed coefficient setting section 80 refers to the vehicle speed coefficient map 90 and thereby sets a vehicle speed coefficient for a time of forward movement on a downslope. Specifically, for example, in the case of the inclination angle being θ2, it refers to the line segment L1 of the vehicle speed coefficient map 90 and then sets the vehicle speed coefficient to α3, and in the case of the inclination angle being θ3, it refers to the line segment L1 of the vehicle speed coefficient map 90 and then sets the vehicle speed coefficient to α1 (refer to FIG. 3). Subsequently, the above-mentioned processing of step S5 and processing of step S6 are performed, and thereafter processing of step S1 onwards is repeatedly performed.

If, in step S11, it is determined by the control section 18 that the slope is not a downslope (the slope is an upslope), then in step S13, the vehicle speed coefficient setting section 80 refers to the vehicle speed coefficient map 90 and thereby sets a vehicle speed coefficient for a time of forward movement on an upslope. Specifically, for example, in the case of the inclination angle being θ2, it refers to the line segment L1 of the vehicle speed coefficient map 90 and then sets the vehicle speed coefficient to α3, and in the case of the inclination angle being θ3, it refers to the line segment L1 of the vehicle speed coefficient map 90 and then sets the vehicle speed coefficient to α1 (refer to FIG. 3). Subsequently, the above-mentioned processing of step S5 and processing of step S6 are performed, after which processing of step S1 onwards is repeatedly performed.

Next, an example where such a snow removal machine 10 is used to perform an oblique stepped clearing operation of snow, will be described with reference to FIGS. 5A to 5C. Note that in FIG. 5A, an angle of a slope surface SL1 with respect to a horizontal plane (the detected inclination angle θ) is assumed to be larger than the inclination angle θ1.

Figure 5A:
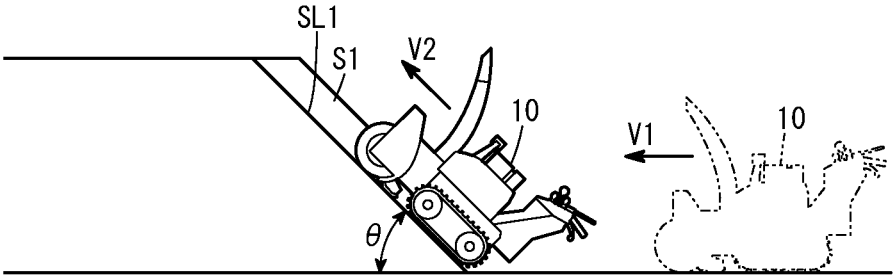
FIG. 5A is a first explanatory diagram explaining an oblique stepped clearing operation of snow.
Figure 5B:
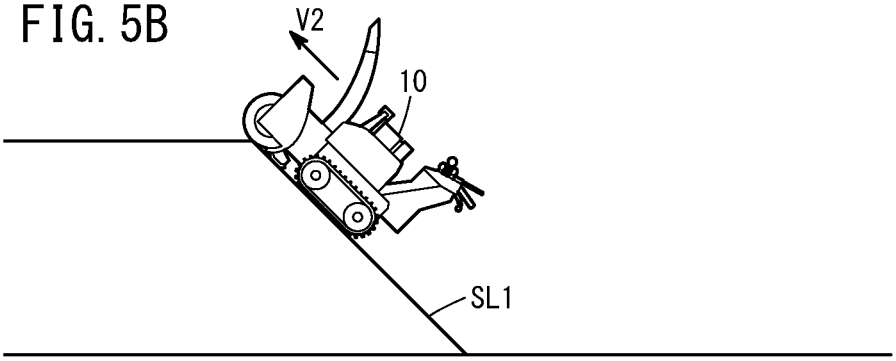
FIG. 5B is a second explanatory diagram explaining the oblique stepped clearing operation of snow.

As shown in FIG. 5A, in the oblique stepped clearing operation of snow, in the case where snow removal of an upper layer snowfall portion S1 is performed, the snow removal machine 10 that has been traveling at an instructed vehicle speed V1 is decelerated to a vehicle speed V2 on the slope surface SL1. At this time, the snow removal machine 10 is decelerated gradually from the instructed vehicle speed V1 to the vehicle speed V2. The vehicle speed V2 is a value obtained by multiplying the instructed vehicle speed V1 by a vehicle speed coefficient set by referring to the line segment L1 of the vehicle speed coefficient map 90 (refer to FIG. 3). As a result, the traveling section 14 (the crawler sections 42L, 42R) is prevented from getting stuck in the snow when moving forward along the upward-sloping slope surface SL1. Moreover, as shown in FIG. 5B, when the snow removal machine 10 has reached an uppermost section of the slope surface SL1 (an end position) and the snow load has been removed, the snow removal machine 10 is prevented from accelerating.

Figure 5C:
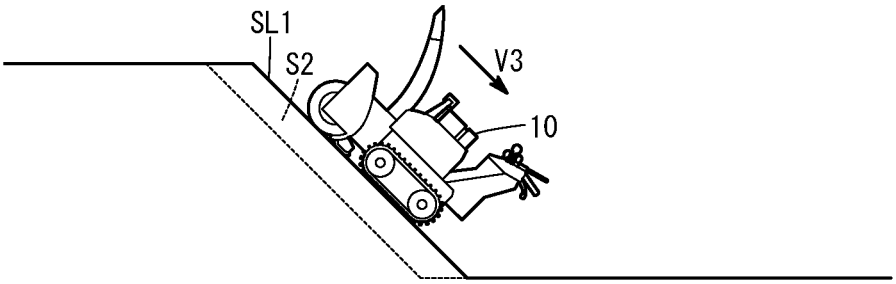
FIG. 5C is a third explanatory diagram explaining the oblique stepped clearing operation of snow.

As shown in FIG. 5C, the snow removal machine 10 that has reached the uppermost section of the slope surface SL1 moves backward along the slope surface SL1 to return to a start position in order to perform snow removal work of a lower layer snowfall portion S2. At this time, the snow removal machine 10 moves backward at a vehicle speed V3 on the slope surface SL1. The vehicle speed V3 is a value obtained by multiplying the instructed vehicle speed V1 by the vehicle speed coefficient set by referring to the line segment L2 of the vehicle speed coefficient map 90 (refer to FIG. 3). In the present embodiment, the vehicle speed V3 is slower than the vehicle speed V2. As a result, the traveling section 14 (the crawler sections 42L, 42R) is prevented from getting stuck in the snow when moving backward along the downward-sloping slope surface SL1. Moreover, it is possible to suppress such a situation that, due to action of gravity, the vehicle speed of the snow removal machine 10 moving backward along the slope surface SL1 becomes excessively fast.

Figure 6A:
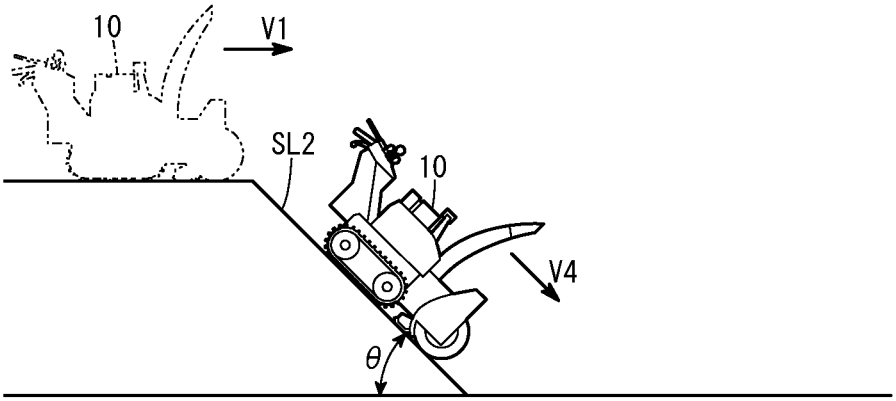
FIG. 6A is an explanatory diagram of an example of the snow removal machine moving forward along a downslope.

Next, an example where the snow removal machine 10 moves forward along a downward-sloping slope surface SL2 when passing along a level difference portion, will be described with reference to FIG. 6A. In FIG. 6A, an angle of the slope surface SL2 with respect to a horizontal plane (the detected inclination angle θ) is larger than the inclination angle θ1. The inclination angle of the slope surface SL2 of FIG. 6A is the same as the inclination angle of the above-mentioned slope surface SL1.

As shown in FIG. 6A, in the case of moving forward along the downward-sloping slope surface SL2, the snow removal machine 10 that has been traveling at the instructed vehicle speed V1 is decelerated to a vehicle speed V4 on the downward-sloping slope surface SL2. At this time, the snow removal machine 10 is decelerated gradually from the instructed vehicle speed V1 to the vehicle speed V4. The vehicle speed V4 is a value obtained by multiplying the instructed vehicle speed V1 by a vehicle speed coefficient set by referring to the line segment L1 of the vehicle speed coefficient map 90 (refer to FIG. 3). The vehicle speed V4 is the same as the vehicle speed V2. As a result, the traveling section 14 (the crawler sections 42L, 42R) is prevented from getting stuck in the snow when moving forward along the downward-sloping slope surface SL2.

Figure 6B:
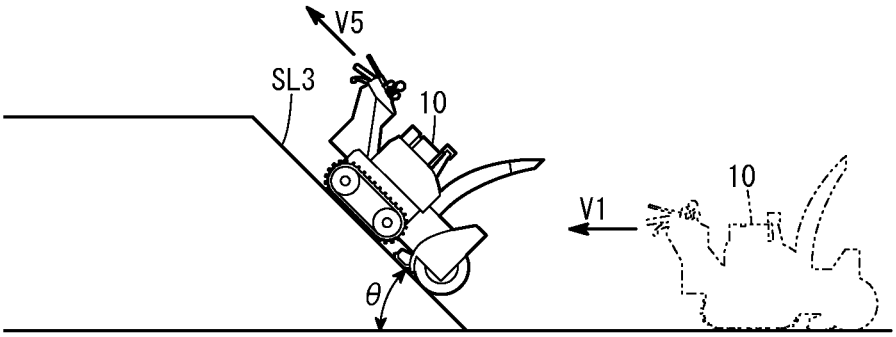
FIG. 6B is an explanatory diagram of an example of the snow removal machine moving backward along an upslope.

Next, an example where the snow removal machine 10 moves backward along an upward-sloping slope surface SL3 when passing along a level difference portion, will be described with reference to FIG. 6B. In FIG. 6B, an angle of the slope surface SL3 with respect to a horizontal plane (the detected inclination angle θ) is larger than the inclination angle θ1. The inclination angle of the slope surface SL3 of FIG. 6B is the same as the inclination angles of the above-mentioned slope surface SL1 and slope surface SL2.

As shown in FIG. 6B, in the case of moving backward along the upward-sloping slope surface SL3, the snow removal machine 10 that has been traveling at the instructed vehicle speed V1 is decelerated to a vehicle speed V5 on the upward-sloping slope surface SL3. At this time, the snow removal machine 10 is decelerated gradually from the instructed vehicle speed V1 to the vehicle speed V5. The vehicle speed V5 is a value obtained by multiplying the instructed vehicle speed V1 by a vehicle speed coefficient set by referring to the line segment L3 of the vehicle speed coefficient map 90 (refer to FIG. 3). The vehicle speed V5 is faster than the vehicle speeds V2 to V4. As a result, the traveling section 14 (the crawler sections 42L, 42R) is prevented from getting stuck in the snow when moving backward along the upward-sloping slope surface SL3. Moreover, it is possible to suppress such a situation that the snow removal machine 10 is slow in movement when moving backward along the upward-sloping slope surface SL3.

Next, operational advantages of the snow removal machine 10 according to the present embodiment will be described below.

The snow removal machine 10 includes: the inclination angle detecting section 76 that detects the inclination angle with respect to a horizontal plane in the front-rear direction of the traveling section 14; and the control section 18. The control section 18 includes: the storage section 88 that has stored therein the vehicle speed coefficient map 90 indicating the relationship between the vehicle speed coefficient for decreasing the instructed vehicle speed and the inclination angle; the vehicle speed coefficient setting section 80 that sets the vehicle speed coefficient based on the inclination angle detected by the inclination angle detecting section 76, and the vehicle speed coefficient map 90; and the vehicle speed setting section 82 that sets the vehicle speed of the traveling section 14 by multiplying the instructed vehicle speed by the vehicle speed coefficient set by the vehicle speed coefficient setting section 80.

The vehicle speed coefficient map 90 is set so that, at least in the case of the traveling section 14 moving forward along an upslope, the larger the inclination angle becomes, the smaller the vehicle speed coefficient becomes, and the travel control section 84 controls the drive source 44 so that the traveling section 14 travels at the set vehicle speed set by the vehicle speed setting section 82. In this case, the vehicle speed of the traveling section 14 can be set by multiplying the instructed vehicle speed by the vehicle speed coefficient set based on the inclination angle and the vehicle speed coefficient map 90, hence, the traveling section 14 can be decelerated at least when the traveling section 14 moves forward along an upslope, by simple control. As a result, the traveling section 14 can be prevented from getting stuck in the snow.

The vehicle speed coefficient map 90 is set so that, in the case of the traveling section 14 moving forward along an upslope, in the case of the traveling section 14 moving forward along a downslope, in the case of the traveling section 14 moving backward along an upslope, and in the case of the traveling section 14 moving backward along a downslope, the larger the inclination angle becomes, the smaller the vehicle speed coefficient becomes. As a result, the traveling section 14 can be effectively prevented from getting stuck in the snow.

The vehicle speed coefficient map 90 is set so that, between the cases of the traveling section 14 moving forward and moving backward along a slope, the vehicle speed coefficients with respect to the same inclination angle differ from each other. As a result, the vehicle speed of the traveling section 14 can be changed between the cases of the traveling section 14 moving forward and moving backward, even if the instructed vehicle speeds are the same.

The vehicle speed coefficient map 90 is set so that, between the cases of the traveling section 14 ascending and descending a slope, the vehicle speed coefficients with respect to the same inclination angle differ from each other. As a result, the vehicle speed of the traveling section 14 can be changed between the cases of the traveling section 14 ascending and descending a slope, even if the instructed vehicle speeds are the same.

The vehicle speed coefficient map 90 is set so that, on upslopes of the same inclination angle, the vehicle speed coefficient in the case of the traveling section 14 moving backward is larger than the vehicle speed coefficient in the case of the traveling section 14 moving forward. As a result, it is possible to suppress such a situation that it is slow in movement in the case of moving backward along an upslope. Note that usually, in the case of the snow removal machine 10 moving backward along an upslope, snow removal work is not performed, hence there is no problem even if a backward movement vehicle speed of the snow removal machine 10 is comparatively high.

The vehicle speed coefficient map 90 is set so that the lower limit of the vehicle speed coefficient is 0.25. As a result, it is possible to suppress such a situation that the vehicle speed of the traveling section 14 becomes excessively slow.

The vehicle speed coefficient map 90 is set so that in the case of the inclination angle being 10° or less, the vehicle speed coefficient is 1. As a result, the traveling section 14 can be caused to travel smoothly in the case of there being a gentle inclination angle at which it is comparatively difficult for getting-stuck to occur.

The travel control section 84 controls the drive source 44 so that the traveling section 14 gradually accelerates or decelerates to the set vehicle speed. As a result, a sudden change in vehicle speed of the traveling section 14 can be suppressed.

The present invention is not limited to the above-mentioned configuration. In the case of implementing another control (such as control of a load of the auger 20), other than control of travel of the traveling section 14, the vehicle speed setting section 82 may set the vehicle speed of the traveling section 14 by multiplying the instructed vehicle speed by the vehicle speed coefficient and a load coefficient. Now, the load coefficient is a value of 1 or less. As a result, it is possible to suppress such a situation that the auger 20 is subjected to an excessive load.

In the vehicle speed coefficient map 90, the line segment L2 indicating the relationship between the inclination angle and the vehicle speed coefficient in the case of moving backward along a downslope may be the same as the line segment L1 indicating the relationship between the inclination angle and the vehicle speed coefficient in the case of moving forward along an upslope and a downslope.

The snow removal machine according to the present invention is not limited to the above-mentioned embodiment, and it goes without saying that a variety of configurations may be adopted without departing from the gist and essence of the present invention.

What is claimed is:

1. A snow removal machine comprising: a traveling section which is provided with a snow removal section configured to perform snow removal work, the traveling section being configured to travel under action of a drive source; and a travel control section configured to control the drive source, the snow removal machine including:

an inclination angle detecting section configured to detect an inclination angle with respect to a horizontal plane in a front-rear direction of the traveling section;

a storage section that has stored therein a vehicle speed coefficient map indicating a relationship between a vehicle speed coefficient for decreasing an instructed vehicle speed and the inclination angle;

a vehicle speed coefficient setting section configured to set the vehicle speed coefficient based on the inclination angle detected by the inclination angle detecting section, and the vehicle speed coefficient map; and a vehicle speed setting section configured to set the vehicle speed of the traveling section by multiplying the instructed vehicle speed by the vehicle speed coefficient set by the vehicle speed coefficient setting section, wherein the vehicle speed coefficient map is set so that, at least in a case of the traveling section moving forward along an upslope, as the inclination angle becomes larger, the vehicle speed coefficient becomes smaller, and the travel control section controls the drive source so that the traveling section travels at a set vehicle speed set by the vehicle speed setting section.

2. The snow removal machine according to claim 1, wherein the vehicle speed coefficient map is set so that, in the case of the traveling section moving forward along an upslope, in a case of the traveling section moving forward along a downslope, in a case of the traveling section moving backward along an upslope, and in a case of the traveling section moving backward along a downslope, as the inclination angle becomes larger, the vehicle speed coefficient becomes smaller.

3. The snow removal machine according to claim 2, wherein the vehicle speed coefficient map is set so that, between the cases of the traveling section moving forward and moving backward along a slope, the vehicle speed coefficients with respect to a same inclination angle differ from each other.

4. The snow removal machine according to claim 2, wherein the vehicle speed coefficient map is set so that, between cases of the traveling section ascending and descending a slope, the vehicle speed coefficients with respect to a same inclination angle differ from each other.

5. The snow removal machine according to claim 2, wherein the vehicle speed coefficient map is set so that, on upslopes of a same inclination angle, the vehicle speed coefficient in the case of the traveling section moving backward is larger than the vehicle speed coefficient in the case of the traveling section moving forward.

6. The snow removal machine according to claim 1, wherein the vehicle speed coefficient map is set so that a lower limit of the vehicle speed coefficient is 0.25.

7. The snow removal machine according to claim 1, wherein the vehicle speed coefficient map is set so that in a case of the inclination angle being 10° or less, the vehicle speed coefficient is 1.

8. The snow removal machine according to claim 1, wherein the travel control section controls the drive source so that the traveling section gradually accelerates or decelerates to the set vehicle speed.

* * * * *